United States Patent [19]

Gilbert

[11] 4,240,202

[45] Dec. 23, 1980

[54] REPLACEABLE BLADE KNIFE

[75] Inventor: Richard Gilbert, Sheffield, England

[73] Assignee: Stanley Tools Limited, Great Britain

[21] Appl. No.: 939,953

[22] Filed: Sep. 6, 1978

[30] Foreign Application Priority Data

Sep. 8, 1977 [GB] United Kingdom ..... 37574/77

[51] Int. Cl.[3] ..... B26B 3/06

[52] U.S. Cl. ..... 30/162; 30/320; 30/331; 30/335

[58] Field of Search ..... 30/162, 320, 335, 332, 30/333, 331, 330

[56] References Cited

U.S. PATENT DOCUMENTS

| | | | |
|---|---|---|---|
| 1,668,077 | 5/1928 | Hubbell | 30/333 |
| 1,726,017 | 8/1929 | Des Enfants | 30/333 |
| 1,829,499 | 10/1931 | Boos | 30/330 |
| 2,061,669 | 11/1936 | Orman | 30/320 |
| 2,250,237 | 7/1941 | Schwartzkopf | 30/332 |
| 2,463,682 | 3/1949 | Doniger | 30/331 |
| 2,820,293 | 1/1958 | Seldon | 30/331 |
| 3,078,572 | 2/1963 | Everton | 30/333 |
| 3,448,518 | 6/1969 | Sklar | 30/335 |
| 4,005,525 | 2/1977 | Gringer | 30/331 |

FOREIGN PATENT DOCUMENTS

| | | | |
|---|---|---|---|
| 133868 | 9/1929 | Switzerland | 30/320 |
| 270867 | 5/1927 | United Kingdom | 30/333 |

*Primary Examiner*—Othell M. Simpson
*Assistant Examiner*—J. T. Zatarga
*Attorney, Agent, or Firm*—Prutzman, Kalb, Chilton & Alix

[57] ABSTRACT

A retractable blade knife 10 comprises an elongate handle 11 which is in two halves 14, 15 clamping therebetween a replaceable blade 12 which can be extended and retracted by means of a cursor 18 and which has "break-lines" 32 for breaking off successive end portions 33. To clamp the blade 12 firmly in use, a screw 27 at the rear end of the handle can be turned to produce relative longitudinal sliding between the two handle halves 14, 15, whereupon an inclined "wedging" surface 17 at the front end of the handle 11 clamps the two halves 14 and 15 together with the blade 12 between them.

3 Claims, 14 Drawing Figures

REPLACEABLE BLADE KNIFE

FIELD OF THE INVENTION

This invention relates to a replaceable blade knife.

SUMMARY

According to the invention, there is provided a replaceable blade knife comprising an elongated handle and a replaceable blade arranged to project in use from one end of the handle, the handle being in two halves, characterized in that the two halves of the handle are interconnected at one end for relative sliding and pivotal movement of the two handle halves, the two handle halves having interengaging shoulders at the other end at least one of which has inclined surface such that the relative sliding movement of the handle halves causes the two handle halves to be secured together and the blade to be firmly clamped therebetween.

DETAILED DESCRIPTION OF PREFERRED EMBODIMENT

Figure 1:
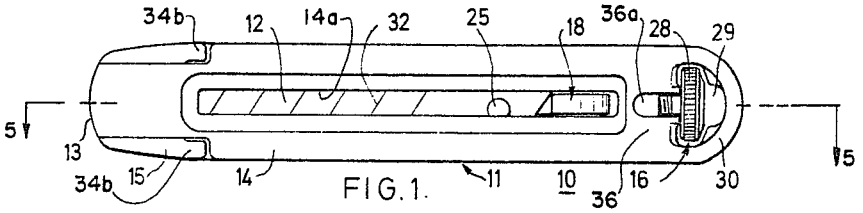
FIG. 1 is a front view of a replaceable blade knife embodying the invention.
Figure 2:
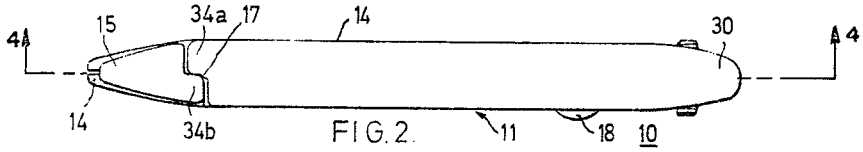
FIG. 2 is a top view thereof.
Figure 3:
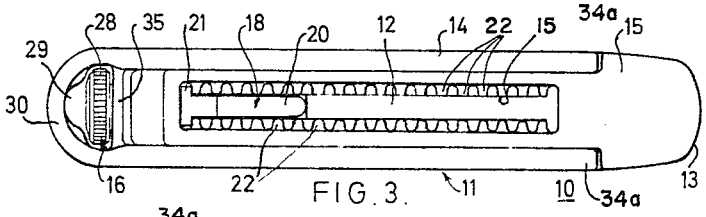
FIG. 3 is a rear view thereof.
Figure 4:
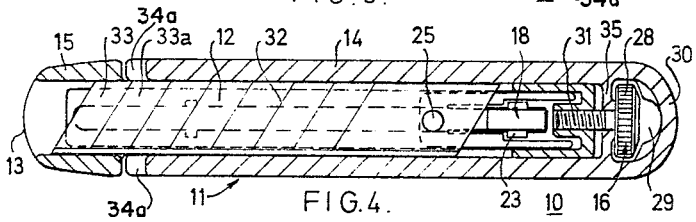
FIG. 4 is a cross sectional view taken generally along line 4—4 of FIG. 2.

Referring to FIGS. 1 to 11 of the drawings, there is illustrated a replaceable blade knife 10 comprising an elongate handle 11 and a replaceable blade 12, the blade 12 being arranged to project in use from a slot in one end 13 of the handle 11. The handle 11 is formed in two parts or handle halves 14 and 15 which are interconnected at the other end 30 for a relative sliding and pivotal movement between the two handle halves 14 and 15. As shown in FIGS. 1 and 2, the handle half 14 is provided with a pair of depending side walls which straddle the end of handle half 15 and provide a pair of shoulders 34*a* which interengage with a pair of shoulders 34*b* of handle half 15. As shown, the surface 17 of shoulders 34*a* is inclined or longitudinally tapered so that relative sliding movement of the two handle halves 14 and 15 interengage the shoulders 34*a* and 34*b* causing the handle halves 14 and 15 to be wedged together at said one end 13 of handle 11 and to clamp the blade 12 firmly therebetween.

Figure 5:
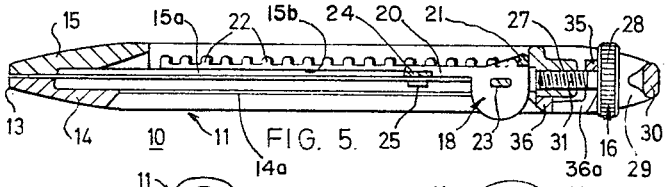
FIG. 5 is a cross sectional view taken generally along line 5—5 of FIG. 1.
Figure 6:
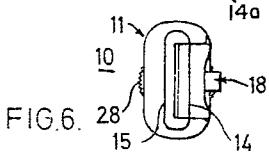
FIG. 6 is a left end view of the knife of FIGS. 1 to 5.
Figure 9:
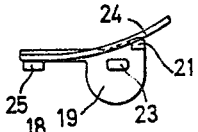
FIG. 9 is a top view of the cursor of the knife.
Figure 10:
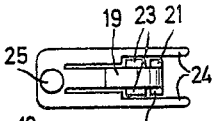
FIG. 10 is a front view thereof.
Figure 8:
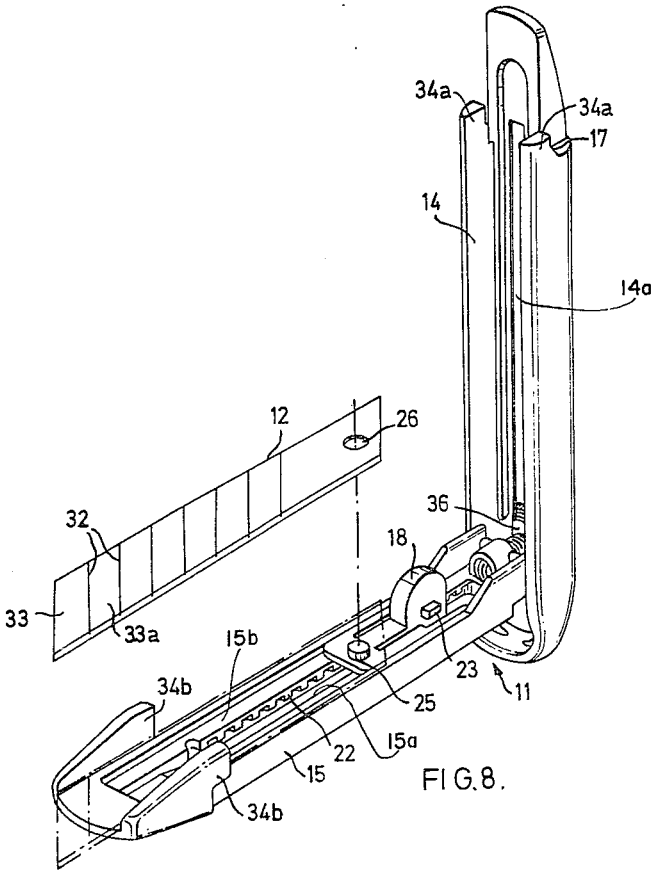
FIG. 8 is a perspective view of the knife of FIGS. 1 to 7, showing the handle opened up and the blade removed.

The blade 12 is preferably retractable into the handle 11 by means of a cursor or blade carrier 18. The cursor or blade carrier 18 is formed with a button 19 at the end of a resilient cantilever arm 20 and projects through a longitudinal slot 14*a* for moving the cursor 18 to the left or to the right as seen in FIGS. 1 and 5. The arm 20 is provided with a pair of dogs 21 which are engageable with teeth 22 which are shown as being formed on the underside of guide rails 15*b* which straddle a longitudinal slot 15*a* in the handle half 15. The cursor is slidably mounted on guide rails 15*b*. As best shown in FIG. 8, the teeth 22 are directed downwardly so that depressing cursor 18 disengages the dogs 21 from teeth 22 so that the longitudinal position of cursor 18 can be adjusted. The button 19 is formed with two stops 23 which are engageable with guide rails 15*a* of handle half 15 to limit the extent of depression of the button 19. The cursor 18 is formed with two resilient guides 24 having a natural curvature as shown in FIG. 9 for guiding the cursor 18 along the handle half 15 and, by virtue of their resiliency, taking up any play in the space for the cursor 18 between the handle halves 14 and 15. Finally, the cursor 18 is formed with a projection 25 which is received in a hole 26 in the blade 12, for mounting the blade so that the blade is advanced and retracted by the cursor.

A fastener 16 is shown as comprising a screw 27 having a screw-head 28 which is knurled for manual rotation of the screw 27 and which occupies a cavity 29 at the end 30 of handle 11. The screw-threaded shank 31 of the screw 27 engages a threaded bore at the rear end of the handle part 15. Accordingly, the screw-thread being in the normal direction, turning the screw-head 28 in the clockwise direction as seen in FIG. 7 causes the screw-head 28 to bear against the right hand end of the handle part 14 as seen in each of FIGS. 1, 2, 4, and 5 and to draw or drive the handle half 15 to the right relative to the handle part 14, causing the two handle halves 14 and 15 to become wedged together at the end 13 due to the interengagement of shoulders 34*a* and 34*b* at the wedging surface 17.

The blade 12 is preferably formed with "break" lines 32 along which successive end portions (such as end portion 33) can be broken off and discarded.

Figure 7:
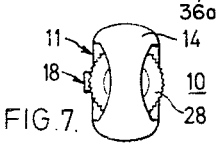
FIG. 7 is a right end view thereof.
Figure 11:
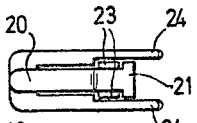
FIG. 11 is a rear view thereof.

To use the knife 10, assuming that it is already fitted with the blade 12, the screw 27 is slightly loosened, that is, rotated counterclockwise as seen in FIG. 7, so as to shift the handle halves 14 and 15 at the wedging surface 17 and unclamp the blade 12. The cursor 18 is then moved to the left by depression of the button 19 to disengage the dogs 21 from the teeth 22 and sliding movement of the cursor 18, until the blade 12 is in its unsheathed position where it projects from the handle end 13 by the desired amount. Release of the cursor button 19 results in the natural resilience of the arm 20 and the guides 24 causing the dogs 21 to latch between two of the teeth 22 at the desired position of the cursor 18. Thereupon the screw 27 is tightened by clockwise rotation of the screw-head 28 as seen in FIG. 7 causing relative longitudinal sliding movement of the parts 14 and 15, the part 15 sliding to the right relative to part 14 as seen in FIGS. 1, 2, 4, and 5, causing the handle parts 14 and 15 to be clamped together at the end 13 of the handle and to clamp the blade 12 very firmly therebetween. When it is desired to move the blade 12 again, the screw 27 is loosened again to allow movement of the cursor 18 and the blade may be returned to its sheathed position.

When the end portion 33 has become blunt, the next end portion 33*a* can be advanced to project from the handle end 13, and the original end portion 33 can be snapped off from the remainder of the blade 12 along the break line 32 separating the portions 33 and 33*a*.

When it is desired to replace the blade 12, the screw 27 is unscrewed sufficiently far for shoulders 34*a* and 34*b* to move clear of each other, whereupon the handle parts 14 and 15 can be pivoted apart to the position shown in FIG. 8. In this position, with the screw shank 31 still engaged in the threaded bore in the handle part 15, the handle 14 is held captive by the screw-head 28 between wall 36 and transverse wall 35 of the handle half 14. As best shown in FIGS. 1 and 5, walls 36 and 35 are provided with a slot 36*a* to accommodate screw shank 31 during the pivotal movement of the handle halves. With the handle halves pivoted as shown in FIG. 8, the blade 12 can be simply lifted off the projection 25 of the cursor 18 and replaced by another blade. The handle halves 14 and 15 can then be pivoted together again and the screw 27 tightened sufficiently for the handle shoulder 34*a* and 34*b* to interengage.

I claim:

1. A retractable blade knife comprising an elongated knife handle with a narrow blade receiving opening at a forward longitudinal end thereof and having a pair of separable elongated mating handle halves on opposite sides of and defining the narrow blade receiving opening, the mating handle halves having cooperating means for relatively longitudinally sliding the mating handle halves in opposite relative longitudinal directions between unlocked and locked relative longitudinal positions thereof and a manually operable blade carrier mounted within the handle between the handle halves for supporting a blade therebetween for manually longitudinally shifting the blade between a retracted sheathed position within the handle and a forward unsheathed position extending through the blade opening, the handle having locking means for locking the handle halves together in their said locked relative positions and comprising sidewise facing, opposed cooperating shoulders on the handle halves respectively engageable to interlock the two halves together as the two halves are relatively longitudinally shifted from their said unlocked to their said locked relative positions and drive means, at the opposite longitudinal end of the handle from said forward end, manually operable to positively relatively longitudinally drive the mating handle halves from their said unlocked to their said locked relative positions and to return the handle halves from their said locked to their said unlocked relative positions, the locking means permitting the handle halves to be separated when in their said unlocked relative positions to provide access to the blade carrier.

2. A retractable blade knife according to claim 1 wherein each said shoulder on at least one of the handle halves is inclined relative to the longitudinal direction of relative movement of the handle halves from their said unlocked to their said locked relative positions to wedge the handle halves together at the forward end of the handle and thereby clamp a blade extending through the blade opening.

3. A retractable blade knife according to claim 1 wherein the drive means comprises a screw with a longitudinally extending threaded shank threaded into one of the handle halves and wherein the other handle half has an elongated slot receiving the screw shank for operatively connecting the handle halves at said opposite end of the handle to permit relative sidewise pivotal movement thereof when in their said unlocked relative positions.

* * * * *